US006560874B1

(12) United States Patent
DeMezzo

(10) Patent No.: US 6,560,874 B1
(45) Date of Patent: May 13, 2003

(54) CLIPPER/STRIPPER WITH ATTACHED STABILIZING STRUCTURE

(75) Inventor: Gary F. DeMezzo, Milford, CT (US)

(73) Assignee: Inventioneers LLC, Southbury, CT (US)

( * ) Notice: Subject to any disclaimer, the term of this patent is extended or adjusted under 35 U.S.C. 154(b) by 117 days.

(21) Appl. No.: 09/692,369

(22) Filed: Oct. 20, 2000

(51) Int. Cl.[7] ..... A45D 29/02

(52) U.S. Cl. ..... 30/28; 30/298; 132/73.5; D28/60

(58) Field of Search ..... 30/28, 298, 232, 30/291; 132/75.5, 75.4, 73.5; D28/56, 57, 60

(56) References Cited

U.S. PATENT DOCUMENTS

| | | | | | |
|---|---|---|---|---|---|
| 64,919 | A | * | 5/1867 | Stedman | 30/298 X |
| 93,455 | A | * | 8/1869 | Leavitt | 30/298 X |
| 161,112 | A | * | 3/1875 | Fogerty | 132/73.5 |
| 846,924 | A | * | 3/1907 | Kampfe | 132/75.5 |
| 860,975 | A | * | 7/1907 | Havell | 132/75.5 X |
| 3,997,966 | A | | 12/1976 | Sartore | |
| 4,819,673 | A | * | 4/1989 | McMullen, Jr. | 132/75.5 |
| 4,860,448 | A | * | 8/1989 | Husain | 132/75.5 X |
| 5,052,416 | A | * | 10/1991 | Rommerdale | 30/28 X |
| D344,366 | S | | 2/1994 | Soriano | |
| 5,384,960 | A | | 1/1995 | Tottenham | |
| 5,490,327 | A | * | 2/1996 | Ohori | 30/28 |
| 5,531,025 | A | | 7/1996 | Albone | |
| 5,546,658 | A | * | 8/1996 | MacLeod et al. | 30/28 |
| 5,570,509 | A | * | 11/1996 | Killian | 30/28 |
| 5,622,191 | A | * | 4/1997 | McMullen, Jr. et al. | 132/75.5 |
| 5,870,826 | A | | 2/1999 | Lewan | |
| 6,220,251 | B1 | * | 4/2001 | Jeong et al. | 30/28 X |

* cited by examiner

*Primary Examiner*—Charles Goodman
(74) *Attorney, Agent, or Firm*—John H. Crozier

(57) ABSTRACT

In a preferred embodiment, a clipper/stripper, including: a generally V-shaped spring member; opposed cutting edges formed on distal ends of legs of said V-shaped spring member at a distal, open end of the spring member; a cam lever having a distal end therefore attached near the distal, open end of the spring member, such that pressing proximal ends of the spring member and the cam lever together causes the cutting edges to close or partially close, thus severing a portion of an item placed therebetween or stripping one material from another; and a cylindrical stabilizing structure attached near the proximal end of the spring member and extending generally horizontally orthogonally from a major axis of the clipper/stripper and generally parallel to the cutting edges.

10 Claims, 2 Drawing Sheets

CLIPPER/STRIPPER WITH ATTACHED STABILIZING STRUCTURE

BACKGROUND OF THE INVENTION

1. Field of the Invention

The present invention relates to clippers and strippers generally and, more particularly, but not by way of limitation, to a novel clipper/stripper with an attached stabilizer structure.

2. Background Art

While the present invention is described with reference primarily to its use as a nail clipper, it will be understood that it is applicable, as well, to any situation in which it is desired to clip off the end of something or to strip one material from another material. For example, the clipper/stripper of the present invention may be employed to sever a portion of a fishing line or it may be used to strip insulation from a length of wire.

Nail clippers are widely used to shorten and shape fingernails and toenails. Such nail clippers typically include a generally U-shaped spring member having its proximal ends attached together and having parallel cutting edges formed at the distal, open end of the spring member. In use, the length of fingernail or toenail to be clipped is inserted between the cutting edges and the proximal end of a cam lever is pressed toward the proximal ends of the spring member to force the cutting edges together. The spring member and the cam lever have approximately equal lengths such that the distal ends thereof can be grasped by the thumb and forefinger of a user and pressed together.

A major disadvantage of such an arrangement is that the distal ends of the spring member and the cam lever are typically rather narrow, thus making the nail clipper somewhat difficult to control. This may result in a nail being cut longer than desired, but this deficiency can be corrected by making another cut. A more serious problem results when the nail is cut too short which can be painful for a few days. Also, lack of control can lead to trouble in properly shaping the nail.

Similarly, conventional methods of severing a portion of a fishing line or stripping insulation from a wire usually involve using a knife or like item. This has the disadvantage of posing a risk of injury to the user of the knife.

The disadvantages of conventional nail clippers have been recognized and attempts to overcome these disadvantages have been described in the following patents:

U.S. Pat. No. 3,997,966, issued Dec. 21, 1976, to Sartore, and titled COMBINATION NAIL CLIPPER, CLIPPING RECEPTACLE AND REMOVABLE FRONT LID, describes a nail clipper that includes, in pertinent respects, loops attached to the proximal ends of the upper and lower members of the nail clipper into which loops fingers of the user are inserted.

U.S. Pat. No. Des. 344,366, to Soriano, and titled NAIL CUTTER, shows a nail clipper that has pads formed on the proximal ends of the upper and lower ends thereof.

U.S. Pat. No. 5,384,960, issued Jan. 31, 1995, to Tottenham, and titled NAIL CLIPPER, describes a nail clipper similar, in pertinent respects, to the nail clipper described in the '966 patent above.

U.S. Pat. No. 5,531,025, issued Jul. 2, 1996, to Albone, and titled NAIL CLIPPER WITH INDEX FINGER HOLDER, describes a nail clipper that has one of a variety of finger holders attached to the lower surface of the nail clipper and co-axial with the major axis of the nail clipper, into which finger holder an index finger of the user is inserted.

U.S. Pat. No. 5,870,826, issued Feb. 16, 1999, to Lewan, and titled NAIL CLIPPER GRIPPING AID, describes a nail clipper gripping aid that comprises a guide attached to the lower side of the lower member of the nail clipper, the guide being co-axial with the lower member and having at least one opening for the insertion therethrough of at least one finger of the user.

Accordingly, it is a principal object of the present invention to provide a clipper/stripper that has a stabilizing structure attached thereto, the stabilizing structure being securely graspable by a user of the clipper/stripper.

It is a further object of the invention to provide such a clipper/stripper that permits improved control of the clipper/stripper.

It is another object of the invention to provide such a clipper/stripper that can be economically and easily manufactured.

It is an additional object of the invention to provide such a clipper/stripper that can be used to trim toenails and fingernails.

It is yet a further object of the invention to provide such a clipper/stripper that can be used to cut objects such as severing a portion of a fishing line.

It is yet another object of the invention to provide such a clipper/stripper that can be used to strip one material from another material, such as insulation from a wire.

It is yet an additional object of the invention to provide such a clipper/stripper that is naturally comfortable when held in use.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a clipper/stripper, comprising: a generally V-shaped spring member; opposed cutting edges formed on distal ends of legs of said V-shaped spring member at a distal, open end of said spring member; a cam lever having a distal end attached near said distal, open end of said spring member, such that pressing proximal ends of said spring member and said cam lever together causes said cutting edges to close, thus severing a portion of an item placed therebetween or stripping one material from another; and a cylindrical stabilizing structure attached near said proximal end of said spring member and extending generally horizontally orthogonally from a major axis of said clipper/stripper and generally parallel to said cutting edges.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
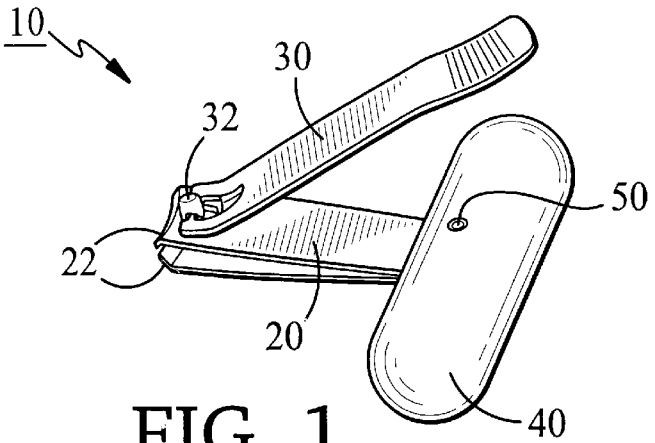
FIG. 1 is an isometric view of a clipper/stripper constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a clipper/stripper, constructed according to the present invention, and generally indicated by the reference numeral 10. Clipper/stripper 10 includes a conventional generally V-shaped spring member 20 having parallel cutting edges 22 formed at the distal, open end of the spring member and having the proximal ends of the spring member attached together. The distal end of a cam lever 30 is attached to spring member 20 near the distal ends thereof by a rivet-like structure 32. In use, and as described above, a fingernail or toenail of a user or other item would be inserted between cutting edges 22 of spring member 20 and the proximal ends of the spring member and cam lever 30 pressed together, thus forcing the cutting edges together and severing the portion of the nail or other item inserted therebetween. Alternatively, cutting edges 22 may be only partially closed, thus permitting the stripping of one material from another material placed therebetween and drawn therethrough. This has the disadvantages described above.

To overcome the disadvantages of conventional clipper/strippers and to provide a clipper/stripper that can be thoroughly and easily stabilized, there is fixedly attached near the proximal end of spring member 20 an elongated stabilizing structure 40 extending generally horizontally orthogonally from the major axis of the clipper/stripper and generally parallel to cutting edges 22. Stabilizing structure 40 is attached to the proximal end of clipper/stripper 10 by means of a rivet, pin, or other suitable attachment means 50. Stabilizing structure 40 is round and has rounded ends, although other shapes may be provided, as well, provided that the stabilizing structure extends generally horizontally orthogonally from the major axis of clipper/stripper 10 and generally parallel to cutting edges 22.

Figure 2:
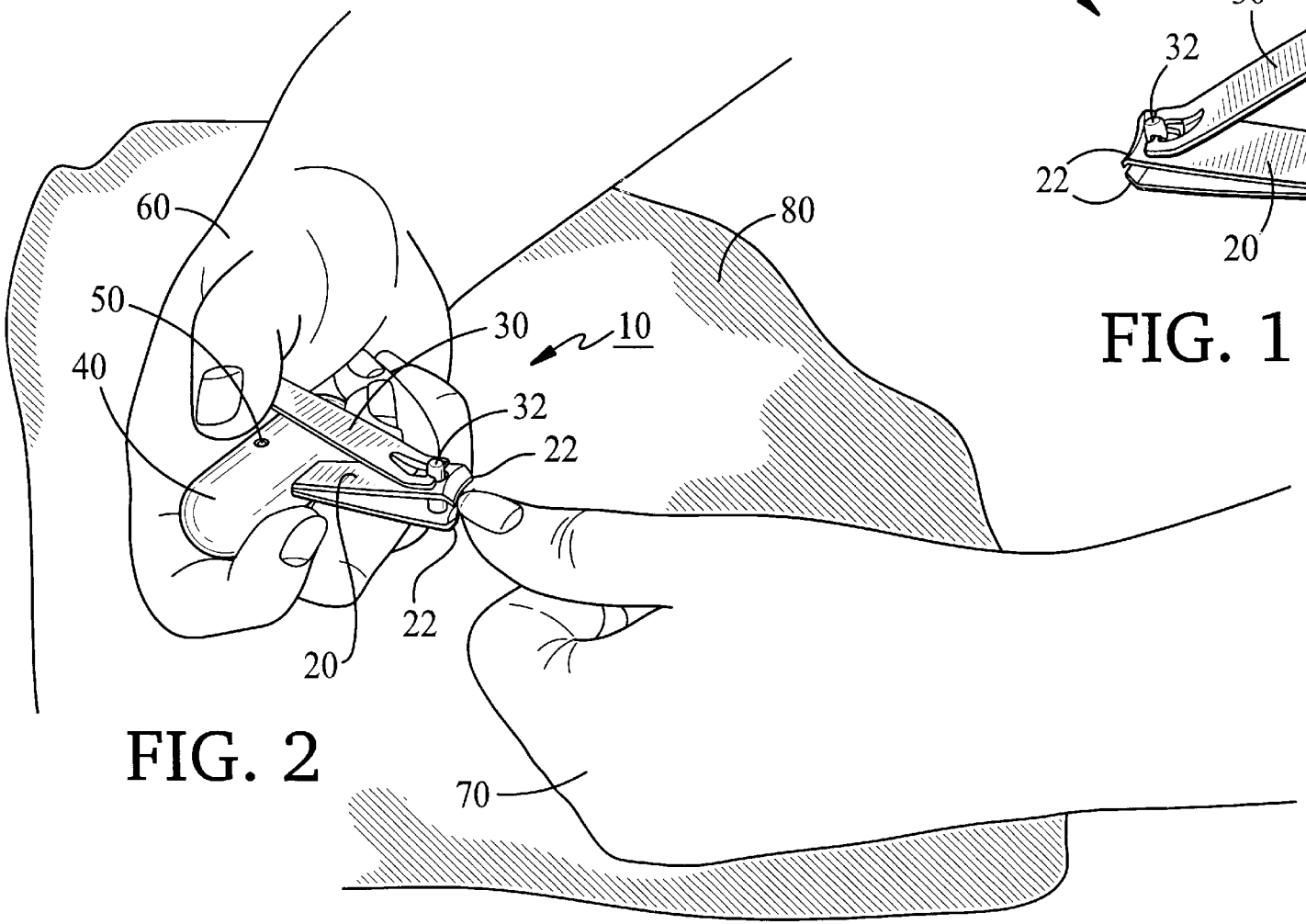
FIG. 2 is an isometric view of the clipper/stripper in use as a fingernail clipper.

FIG. 2 illustrates clipper/stripper 10 in use as a fingernail clipper. Here, clipper/stripper 10 is shown grasped in the right hand 60 of a user, with at least some of the fingers of the right hand curled at least partially around stabilizing structure 40 and with the thumb of the right hand on the end of cam lever 30. A portion of the nail of the thumb of left hand 70 of the user is shown inserted between cutting edges 22 of clipper/stripper 10. Thus arranged, clipper/stripper 10 is securely grasped and stabilized in right hand 60, avoiding the disadvantages of conventional clipper/strippers. To further stabilize the clipping operation, right and left hands 60 and 70 of the user rest on a surface 80.

It will be understood that FIGS. 1 and 2 are provided showing, for illustrative purposes only, the use of clipper/stripper 10 in trimming a fingernail, any number of items can be placed between edges 22 and severed in a like manner.

Stabilizing structure 40 is preferably long enough and extends from either side of spring member 20 such that at least one finger can be curled around the stabilizing structure on either side of the spring member (FIG. 2), although other arrangements may be provided, as well, as long as the stabilizing structure extends generally horizontally orthogonally from the major axis of clipper/stripper 10 and generally parallel to cutting edges 22.

Figure 3:
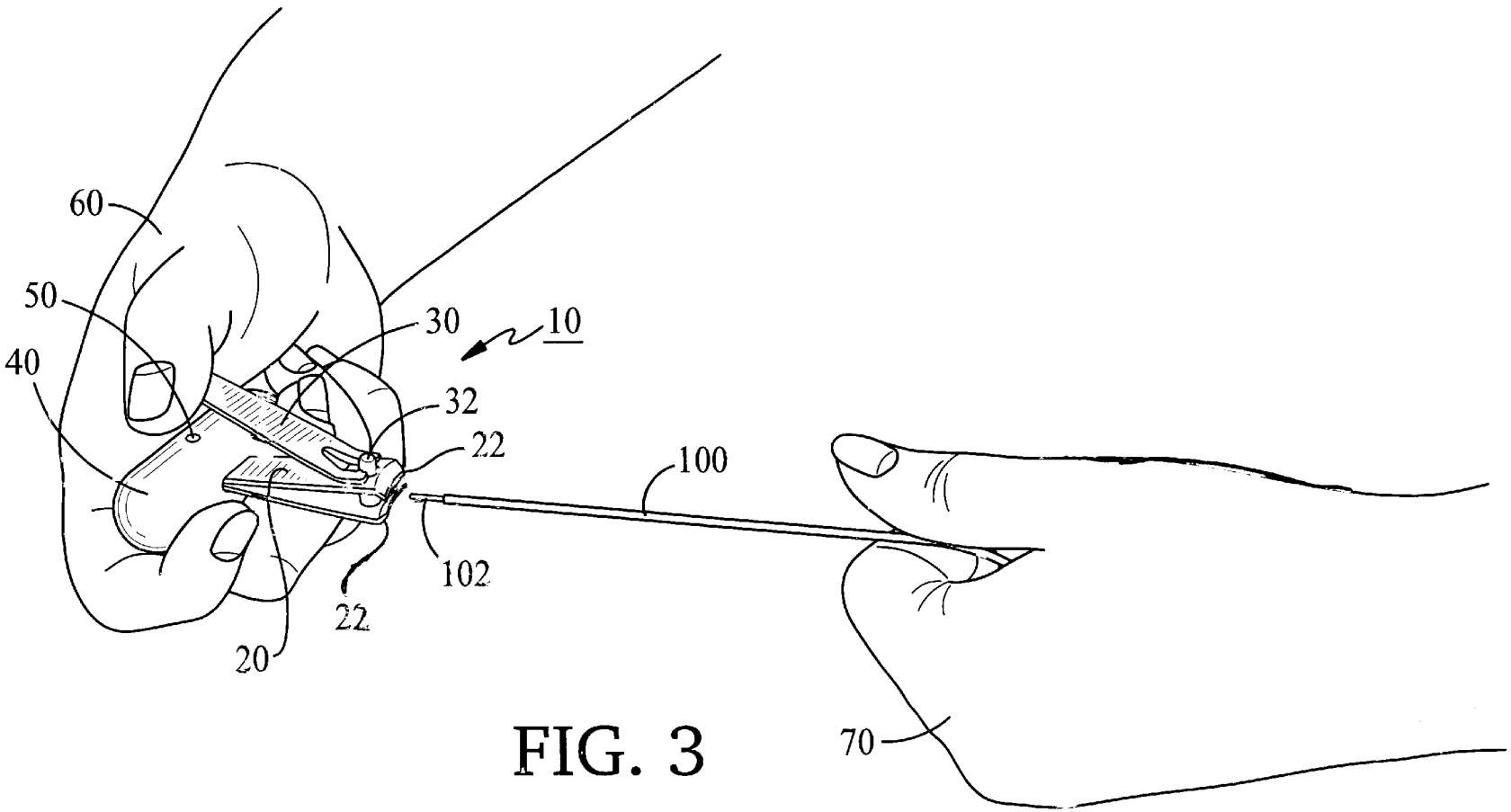
FIG. 3 is an isometric view of the clipper/stripper in use as a wire stripper.

FIG. 3 illustrates the use of clipper/stripper 10 in stripping insulation 100 from a wire 102. Here, clipper/stripper 10 is grasped in right hand 60 of a user, similar in manner to FIG. 2, and an end of wire 102 is grasped in left hand 70 of the user. Wire 102 is inserted between edges 22 at a selected location along the length of the wire. Cam lever 30 is then only partially depressed, thus only partially closing edges 22. With the proper degree of tension applied to cam lever 30 and with relative motion of right hand 60 and left hand 70 away from one another, insulation 100 will be stripped from wire 102 as shown on FIG. 3.

Stabilizing structure 40 (FIG. 1) is about ¾-inch in diameter, about 2 inches long, has rounded ends, and is constructed of a thermoplastic, although other suitable dimensions and materials may be employed within the contemplation of the present invention. Clipper/stripper 10 can be economically constructed by forming stabilizing structure 40 of a thermoplastic by conventional means and attaching the same to the proximal end of a conventional clipper/stripper by means of rivet, pin, or other suitable attachment means 50.

In the embodiments of the present invention described above, it will be recognized that individual elements and/or features thereof are not necessarily limited to a particular embodiment but, where applicable, are interchangeable and can be used in any selected embodiment even though such may not be specifically shown.

Terms such as "upper", "lower", "inner", "outer", "inwardly", "outwardly", "horizontal", "vertical", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A clipper/stripper, comprising:

(a) a generally V-shaped spring member;

(b) opposed cutting edges formed on distal ends of legs of said V-shaped spring member at a distal, open end of said spring member;

(c) a cam lever having a distal end thereof attached near said distal, open end of said spring member, such that pressing proximal ends of said spring member and said cam lever together causes said cutting edges to close, thus severing a portion of an item placed therebetween; and (d) a cylindrical stabilizing structure attached near said proximal end of said spring member and extending generally horizontally orthogonally from a major axis of said clipper/stripper and generally parallel to said cutting edges.

2. A clipper/stripper, as defined in claim 1, wherein: said stabilizing structure extends horizontally from both sides of said spring member.

3. A clipper/stripper, as defined in claim 2, wherein: said stabilizing structure is sufficiently long that at least two fingers of a hand of a user can be curled at least partially around said stabilizing structure, with at least one finger disposed on either side of said spring member.

4. A clipper/stripper, as defined in claim 1, wherein: said stabilizing structure has rounded ends.

5. A clipper/stripper, as defined in claim 1, wherein: said stabilizing structure is about ¾-inch in diameter and about 2 inches long.

6. A clipper/stripper, comprising:

(a) a generally V-shaped spring member;

(b) opposed cutting edges formed on distal ends of legs of said V-shaped spring member at a distal, open end of said spring member;

(c) a cam lever having a distal end thereof attached near said distal, open end of said spring member, such that pressing proximal ends of said spring member and said cam lever together causes said cutting edges to partially close, thus permitting stripping of one material from another material placed therebetween and drawn therethrough; and (d) a cylindrical stabilizing structure attached near said proximal end of said spring member and extending generally horizontally orthogonally from a major axis of said clipper/stripper and generally parallel to said cutting edges.

7. A clipper/stripper, as defined in claim 6, wherein: said stabilizing structure extends horizontally from both sides of said spring member.

8. A clipper/stripper, as defined in claim 6, wherein: said stabilizing structure is sufficiently long that at least two fingers of a hand of a user can be curled at least partially around said stabilizing structure, with at least one finger disposed on either side of said spring member.

9. A clipper/stripper, as defined in claim 6, wherein: said stabilizing structure has rounded ends.

10. A clipper/stripper, as defined in claim 6, wherein: said stabilizing structure is about ¾-inch in diameter and about 2 inches long.

* * * * *